US011441256B2

(12) United States Patent
Lee et al.

(10) Patent No.: US 11,441,256 B2
(45) Date of Patent: Sep. 13, 2022

(54) DRYER

(71) Applicant: SAMSUNG ELECTRONICS CO., LTD., Suwon-si (KR)

(72) Inventors: Dong-woo Lee, Yongin-si (KR); Dong-wook Kim, Suwon-si (KR); Seong-ho Kil, Seongnam-si (KR); Dong-il Back, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 286 days.

(21) Appl. No.: 16/648,912

(22) PCT Filed: Aug. 1, 2018

(86) PCT No.: PCT/KR2018/008730
§ 371 (c)(1),
(2) Date: Mar. 19, 2020

(87) PCT Pub. No.: WO2019/059516
PCT Pub. Date: Mar. 28, 2019

(65) Prior Publication Data

US 2020/0325621 A1 Oct. 15, 2020

(30) Foreign Application Priority Data

Sep. 19, 2017 (KR) ..... 10-2017-0120322

(51) Int. Cl.
*D06F 58/20* (2006.01)
*D06F 58/06* (2006.01)
(Continued)

(52) U.S. Cl.
CPC ..... *D06F 58/20* (2013.01); *D06F 58/04* (2013.01); *D06F 58/06* (2013.01); *D06F 58/26* (2013.01)

(58) Field of Classification Search
CPC ..... D06F 58/04; D06F 58/06; D06F 58/26; D06F 58/20
(Continued)

(56) References Cited

U.S. PATENT DOCUMENTS 2,628,432 A * 2/1953 Morrison ..... D06F 58/04 34/68
3,866,333 A * 2/1975 Sarukahanian ..... D06F 58/24 34/131
(Continued)

FOREIGN PATENT DOCUMENTS

CA 2508607 A1 * 11/2006 ..... D06F 58/04
EP 3031969 B1 * 12/2017 ..... D06F 58/04
(Continued)

OTHER PUBLICATIONS

International Search Report dated Nov. 13, 2019 in International Patent Application No. PCT/KR2018/008730.
(Continued)

*Primary Examiner* — Stephen M Gravini
(74) *Attorney, Agent, or Firm* — Staas & Halsey LLP

(57) ABSTRACT

A dryer is disclosed. The dryer comprises: a body having a first opening disposed at one side thereof; a first drum rotatably disposed in the body and including a first drying chamber connected to the first opening; a first hot-air unit for supplying hot air to the inside of the first drum; a first door coupled to the body to open or close the first opening; a second drum disposed at the first door; and a second hot-air unit for supplying hot air to the inside of the second drum.

13 Claims, 10 Drawing Sheets

(51) Int. Cl.
*D06F 58/04* (2006.01)
*D06F 58/26* (2006.01)

(58) Field of Classification Search
USPC ..... 34/239, 595–610
See application file for complete search history.

(56) References Cited

U.S. PATENT DOCUMENTS

| | | | | |
|---|---|---|---|---|
| 4,091,548 | A * | 5/1978 | Daily | D06F 58/04 34/202 |
| 4,621,438 | A * | 11/1986 | Lanciaux | D06F 58/06 34/604 |
| 5,113,562 | A * | 5/1992 | Studt | D06F 58/04 34/201 |
| 5,546,678 | A * | 8/1996 | Dhaemers | F26B 21/02 34/224 |
| 5,743,025 | A * | 4/1998 | Jordan, Jr. | D06F 58/04 34/600 |
| 7,559,156 | B2 * | 7/2009 | Renzo | D06F 58/04 49/435 |
| 7,644,515 | B2 * | 1/2010 | Doh | D06F 58/22 34/603 |
| 8,127,464 | B2 * | 3/2012 | Schone | D06F 39/14 68/196 |
| 8,266,816 | B2 * | 9/2012 | Lim | D06F 39/14 68/92 |
| 8,607,473 | B2 * | 12/2013 | Choi | D06F 58/20 D32/6 |
| 8,661,707 | B2 * | 3/2014 | Dittmer | D06F 58/04 68/23 R |
| 9,752,267 | B2 * | 9/2017 | Lee | D06F 39/022 |
| 9,765,471 | B2 * | 9/2017 | Kim | D06F 58/04 |
| 9,856,593 | B2 | 1/2018 | Wishney et al. | |
| 9,885,145 | B2 * | 2/2018 | Bae | D06F 58/20 |
| 9,926,659 | B2 | 3/2018 | Kim et al. | |
| 10,570,558 | B2 * | 2/2020 | Um | D06F 58/10 |
| 10,774,462 | B2 * | 9/2020 | Ayers | D06F 60/00 |
| 10,928,131 | B2 * | 2/2021 | Krebs | F26B 23/005 |
| 11,111,623 | B2 * | 9/2021 | Nam | D06F 58/10 |
| 2016/0160424 | A1 * | 6/2016 | Kim | D06F 58/04 34/109 |
| 2018/0187364 | A1 * | 7/2018 | Kim | D06F 37/04 |
| 2020/0325621 | A1 * | 10/2020 | Lee | D06F 58/20 |

FOREIGN PATENT DOCUMENTS

| | | | | |
|---|---|---|---|---|
| JP | 4103512 | | 6/2008 | |
| JP | 2009-78067 | | 4/2009 | |
| KR | 10-1995-0004375 | | 2/1995 | |
| KR | 20-0335754 | | 12/2003 | |
| KR | 10-0499363 | | 7/2005 | |
| KR | 10-0701329 | | 3/2007 | |
| KR | 20-2009-0002545 | | 3/2009 | |
| KR | 10-2012-0022364 | A | 3/2012 | |
| KR | 10-2015-0090768 | | 8/2015 | |
| KR | 10-2015-0118230 | | 10/2015 | |
| KR | 10-1592318 | | 2/2016 | |
| WO | WO-2019059516 | A1 * | 3/2019 | D06F 58/04 |

OTHER PUBLICATIONS

Written Opinion of the International Searching Authority dated Nov. 13, 2019 in International Patent Application No. PCT/KR2018/008730.

Korean Office Action for Korean Patent Application No. 10-2017-0120322 dated Oct. 27, 2021.

* cited by examiner

DRYER

CROSS-REFERENCE TO RELATED APPLICATIONS

This application is a U.S. National Stage Application, which claims the benefit under 35 U.S.C. § 371 of PCT International Patent Application No. PCT/KR2018/008730, filed Aug. 1, 2018 which claims the foreign priority benefit under 35 U.S.C. § 119 of Korean Patent Application No. 10-2017-0120322, filed Sep. 19, 2017, the contents of which are incorporated herein by reference.

TECHNICAL FIELD

The disclosure relates to a dryer including a plurality of drying chambers.

BACKGROUND ART

In general, a dryer is a device rotating a drum in which a wet drying object is accommodated and passing high-temperature dry air into the drum to thereby dry the drying object in the drum. Such a dryer generally refers to a clothes dryer of which a drying object is laundry in a wet state after washing thereof is completed.

In a conventional dryer, a drying object is dried only through a single drum. Regardless of an amount of a drying object, the same energy is consumed for drying a small amount of a drying object as that for drying a large amount of a drying object.

In addition, in the conventional dryer, when delicate clothing made of a soft material such as wool is dried together with drying objects of other materials, the delicate clothing may be damaged by being entangled with laundry of the other material. To prevent the delicate clothing from being damaged due to a high temperature or rapid rotation of the drum, it is required that the delicate clothing be separated and dried apart.

The conventional dryer, which performs drying only through a single drying chamber as described above, has limitations in efficiency, convenience and versatility.

DISCLOSURE

Technical Problem

The disclosure provides a dryer including a plurality of drying chambers to improve efficiency, convenience and versatility.

Technical Solution

According to an embodiment of the disclosure, a dryer includes: a body including a first opening in one side thereof; a first drum rotatably disposed in the body and including a first drying chamber connected to the first opening; a first hot-air supplier configured to supply hot air into the first drum; a first door coupled to the body to open or close the first opening; a second drum disposed on the first door; and a second hot-air supplier configured to supply hot air into the second drum.

The first door may include a second opening passing through the first door and a second door configured to open or close the second opening, and the second drum may include a second drying chamber connected to the second opening.

The dryer may further include a second drum case coupled to the first door, the second drum being rotatably disposed in the second drum case.

The second drum case may include an inlet port through which hot air is introduced from the second hot-air supplier and an exhaust port through which the introduced hot air is discharged, and the second drum may include a plurality of vents facing the inlet port and the exhaust port.

The second hot-air supplier may be disposed adjacent to the inlet port in a state where the first door is closed.

The second drum may be formed in a shape of a cylinder that is open toward the second opening, and the plurality of vents may be formed in an outer circumferential surface of the second drum.

The second drum case may be formed as a shape of a cylinder, and the inlet port and the exhaust port may be formed in an outer circumferential surface of the second drum case.

The second drum case may further include an auxiliary inlet port that is open toward the first drying chamber.

The second drum may further include a plurality of auxiliary vents facing the auxiliary inlet port.

The inlet port, the auxiliary inlet port, and the exhaust port of the second drum case may be formed in a grill structure, and the plurality of vents and the plurality of auxiliary vents of the second drum may be formed in a grill structure.

A driver may be disposed at the first door, and a power transmission member may be coupled to an opening portion of the second drum, the power transmission member transmitting a driving force of the driver to the second drum.

The power transmission member may include a third opening and a gear portion disposed along an outer circumference of the third opening, and the driver may include a motor coupled to the first door and a drive gear coupled to the motor for rotation and engaged with the gear portion.

The dryer may further include an exhaust duct configured to discharge air in the first drum and the second drum to the outside of the body, and an air suction port of the exhaust duct may be disposed close to the exhaust port.

According to another embodiment of the disclosure, a dryer includes a door configured to open or close an opening formed in one side of a body, a drying chamber rotatably disposed inside the body, and a hot-air supplier configured to supply hot air into the drying chamber, wherein an auxiliary drying chamber is disposed inside the door, and an auxiliary hot-air supplier is disposed adjacent to the auxiliary drying chamber to supply hot air into the auxiliary drying chamber.

The auxiliary drying chamber may include a fixed drum including a vent formed in a grill shape; and a rotating drum rotatably disposed inside the fixed drum and including a vent formed in a grill shape in communication with the vent of the fixed drum.

A power transmission member configured to obtain a driving force from a driver for rotation may be coupled to an opening portion of the rotating drum, and the power transmission member may include a through hole formed to communicate with the inside of the rotating drum.

The door may include an auxiliary door configured to open or close the through hole.

The rotating drum may include a plurality of lifters arranged at intervals along an inner circumferential surface thereof.

The auxiliary drying chamber may communicate with the drying chamber.

The auxiliary hot-air supplier may be coupled to an internal side of the body or to the door, and disposed adjacent to the vent of the fixed drum in a state where the door is closed.

BEST MODE

Figure 1:
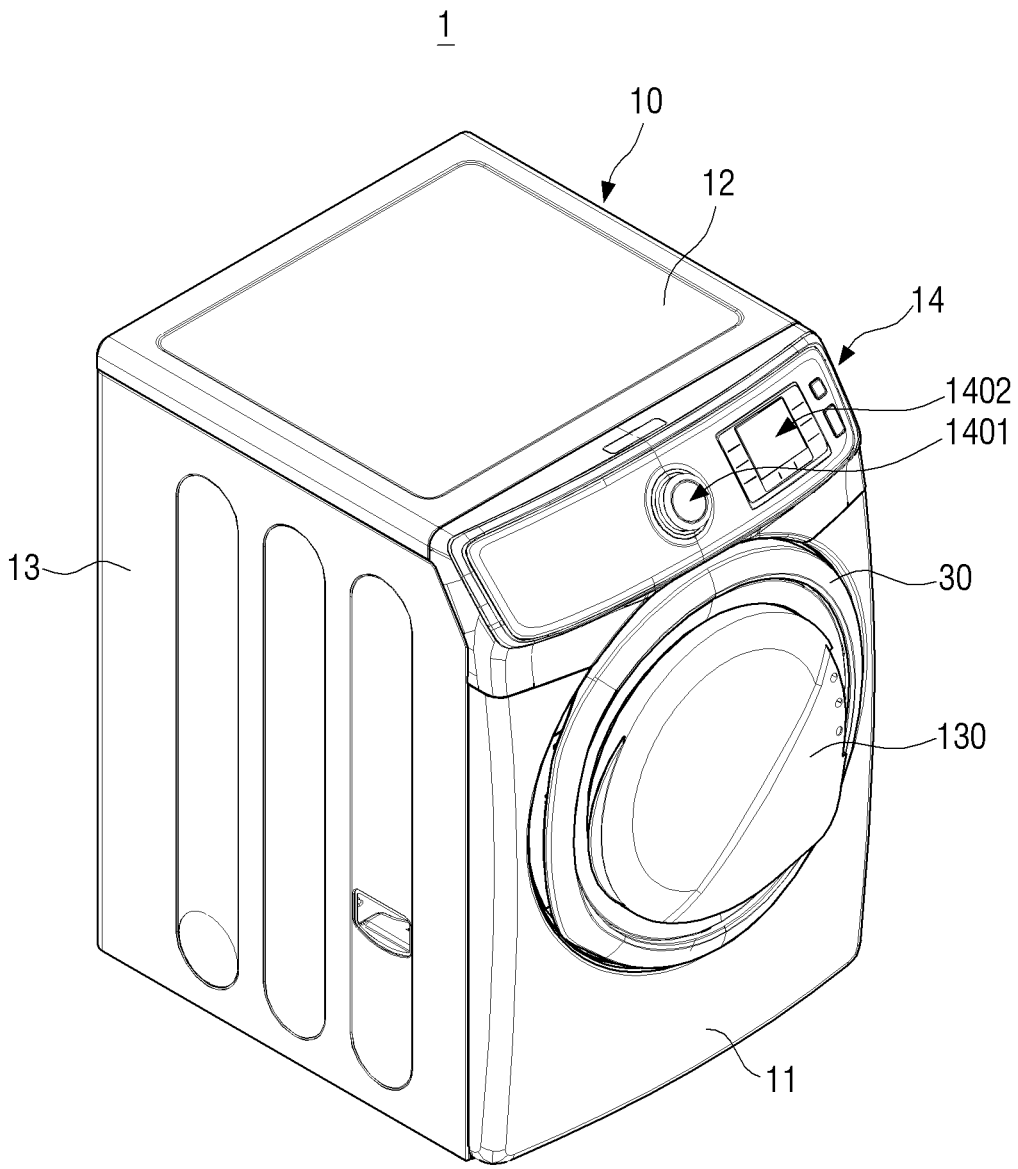
FIG. 1 is a perspective view showing the appearance of a dryer according to an embodiment of the disclosure.

Hereinafter, embodiment of the disclosure will be described in more detail with reference to the accompanying drawings. The embodiments described below will be described based on embodiments which are most suitable for understanding the technical features of the disclosure. It is to be understood that the technical features of the disclosure are not limited by the embodiments, but it is exemplified that the disclosure may be implemented as in the embodiments described below.

Therefore, the disclosure may be variously modified from the embodiments described below within the scope of the disclosure, and it is to be understood that the modified embodiments fall within the scope of the disclosure. In addition, in connection with the reference marks provided in the accompanying drawings to help understand the embodiments described below, the same or extending reference numerals indicate related components among the components that have the same function in the respective embodiments. Further, the accompanying drawings are not necessarily illustrated to scale but dimensions of some components may be exaggerated to help understand the disclosure.

FIG. 1 is a perspective view showing the appearance of a dryer 1 according to an embodiment of the disclosure.

The dryer 1, which will be described below, is a device for drying a drying object by supplying high-temperature dry air to a drying chamber in which the drying object is accommodated. The drying object includes all items that can be dried by hot air. For example, the drying object includes what are implemented with various kinds of fibers and fabrics, such as clothing and towels, and there is no limitation thereto.

As illustrated in FIG. 1, the dryer 1 includes a body 10 defining the appearance thereof. The body 10 may be in a shape of a rectangular parallelepiped extending to be long in a vertical direction.

The body 10 may include a front panel 11, a top panel 12, and a side-rear panel 13.

The body 10 may include a first opening 10H (see FIG. 2) formed in one side thereof, and the first opening 10H may be formed in the front panel 11 to be open toward the front of the body 10.

Hereinafter, for convenience of description, on the basis of the body 10, the direction in which the front panel 11 is disposed will be referred to as the front, and the direction in which a rear panel of the side-rear panel 13 facing the front panel 11 is disposed will be referred to as the rear.

A first door 30 is coupled to the body 10 to open or close the first opening 10H, and the first door 30 further includes a second door 130 coupled to the first door 30 to open or close a second opening 30H (see FIG. 3) passing through the first door 30.

In addition, a control panel 14 may be disposed at an upper end of the front panel 11.

The control panel 14 includes an operation dial 1401 for inputting an operation command for operating the dryer 1 and a display 1402 for displaying operation information of the dryer 1.

The operation dial 1401 may enable a user to select an operation mode of the dryer 1 by rotating it in a gripped state.

The display 1402 may display the operation information of the dryer 1 as a visual image. In addition, the display 1402 may further include a plurality of buttons for receiving user's operation commands, and may be formed as a touch screen.

In addition, a processor (not shown) for controlling the dryer 1 may be disposed in the control panel 14.

Figure 2:
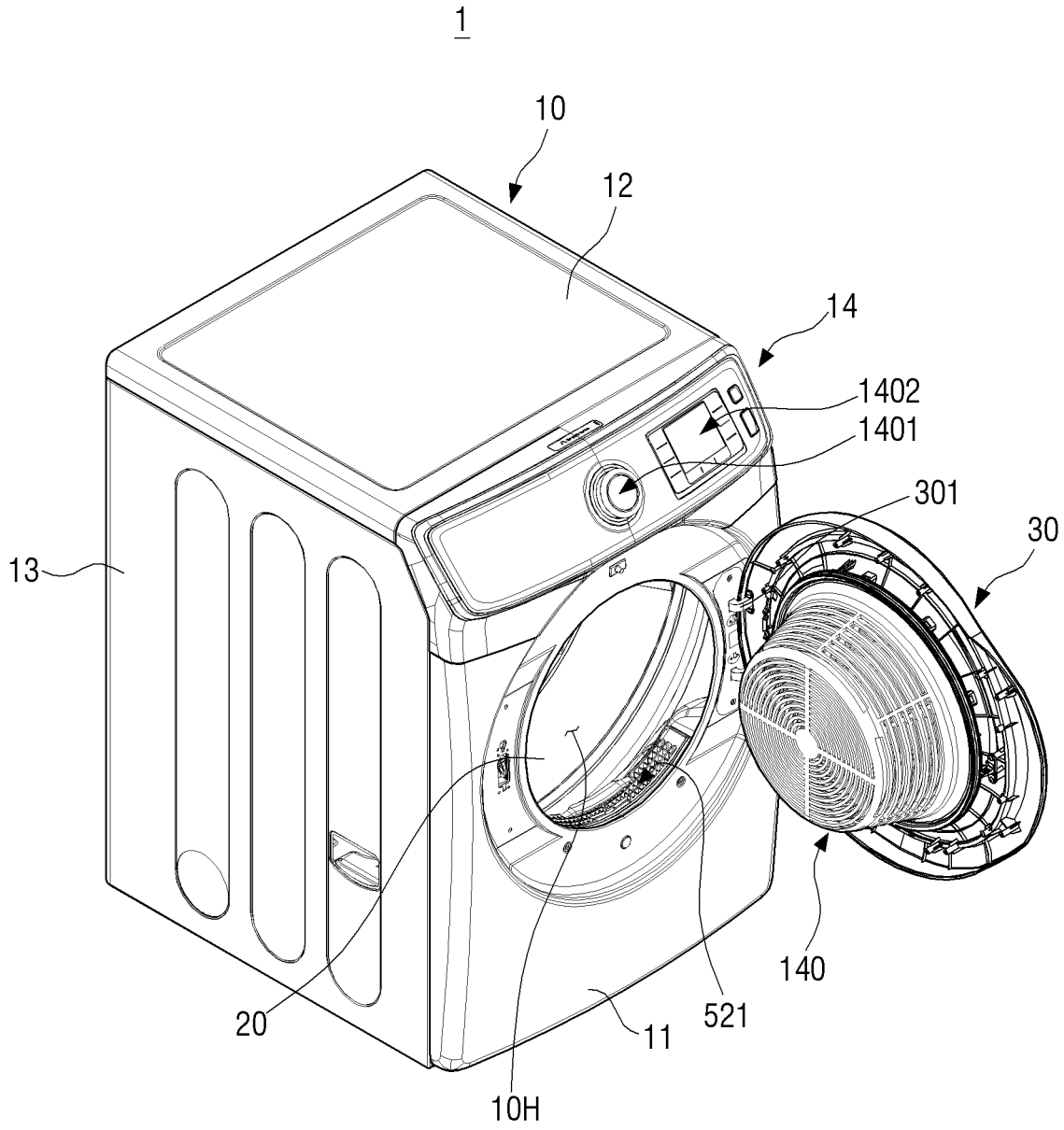
FIG. 2 is a perspective view showing an opened state of a first door of the dryer illustrated in FIG. 1.
Figure 3:
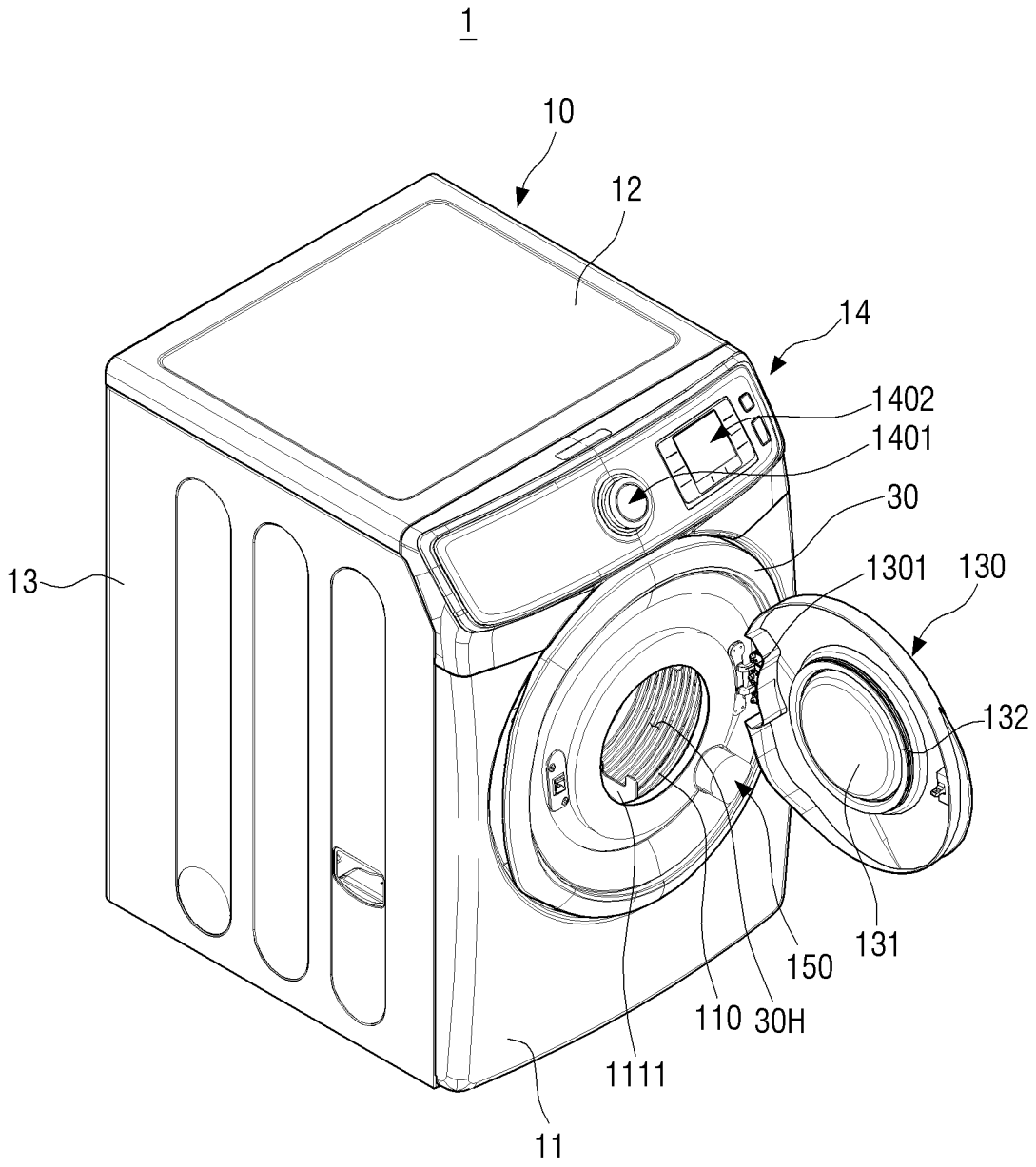
FIG. 3 is a perspective view showing an opened state of a second door of the dryer illustrated in FIG. 1.

FIG. 2 is a perspective view showing an opened state of the first door 30 of the dryer 1 illustrated in FIG. 1, and FIG. 3 is a perspective view showing an opened state of the second door 130 of the dryer 1 illustrated in FIG. 1.

As illustrated in FIG. 2, the first opening 10H may be formed in one side of the body 10, and the first opening 10H may be formed in a circular shape in the front panel 11.

A first drum 20 is rotatably disposed in the body 10, and the first drum 20 is connected to the first opening 10H to insert a drying object through the first opening 10H therein.

Specifically, the first drum 20 includes a first drying chamber 20S (see FIG. 4) connected to the first opening 10H, and a drying object inserted into the first drying chamber 20S through the first opening 10H may be dried by hot air introduced into the first drying chamber 20S.

The first drum 20 may be disposed in a horizontal direction with respect to an installation surface of the body 10, and may be in a shape of a cylinder that rotates with respect to a rotation center disposed in the horizontal direction.

In addition, the rotation center of the first drum 20 may be formed in a front-rear horizontal direction, with a front side portion thereof being open toward the front of the body 10 to be connected to the first opening 10H.

The first drum 20 may rotate through a rotational force of a driving roller 60 (see FIG. 4) that is disposed in the body 10 in contact with an outer circumferential surface of the first drum 20. Based thereon, the first drum 20 may uniformly apply hot air to a drying object inserted into the first drying chamber 20S.

In addition, the first door 30 is coupled to the front panel 11 of the body 10 to open or close the first opening 10H.

The first door 30 is pivotably coupled to the front panel 11 to open or close the first opening 10H.

Specifically, as illustrated in FIG. 2, a first hinge 301 may be disposed at one side of the front panel 11 adjacent to the first opening 10H, and the first door 30 is connected to the first hinge 301 to open or close the first opening 10H by rotating with respect to the first hinge 301.

The first door 30 may be circular to correspond to the shape of the first opening 10H, with a larger diameter than the first opening 10H.

Thus, a drying object may be inserted into the first drying chamber 20S of the first drum 20 through the first opening 10H by opening the first door 30.

In addition, a second drum case 140, which will be described later, is coupled to an internal side surface of the first door 30 as illustrated in FIG. 2, and a second drum 110 is rotatably disposed in the second drum case 140 as illustrated in FIG. 3.

In addition, an air suction port 521 of an exhaust duct 52 is disposed between the first drum 20 and the front panel 11 to discharge hot air used for drying.

After completion of drying, hot air in the first drying chamber 20S may be introduced into the exhaust duct 52 through the air suction port 521 and discharged to the outside of the body 10, and hot air in a second drying chamber 110S, which will be described later, may also be discharged outside through the air suction port 521.

Referring to FIG. 3, the first door 30 includes the second opening 30H formed in a center portion of the first door 30 to pass through the first door 30.

The second opening 30H may be formed in a circular shape in the center portion of the first door 30.

The second drum case 140 is coupled to the internal side surface of the first door 30 to surround the second opening 30H.

Figure 4:
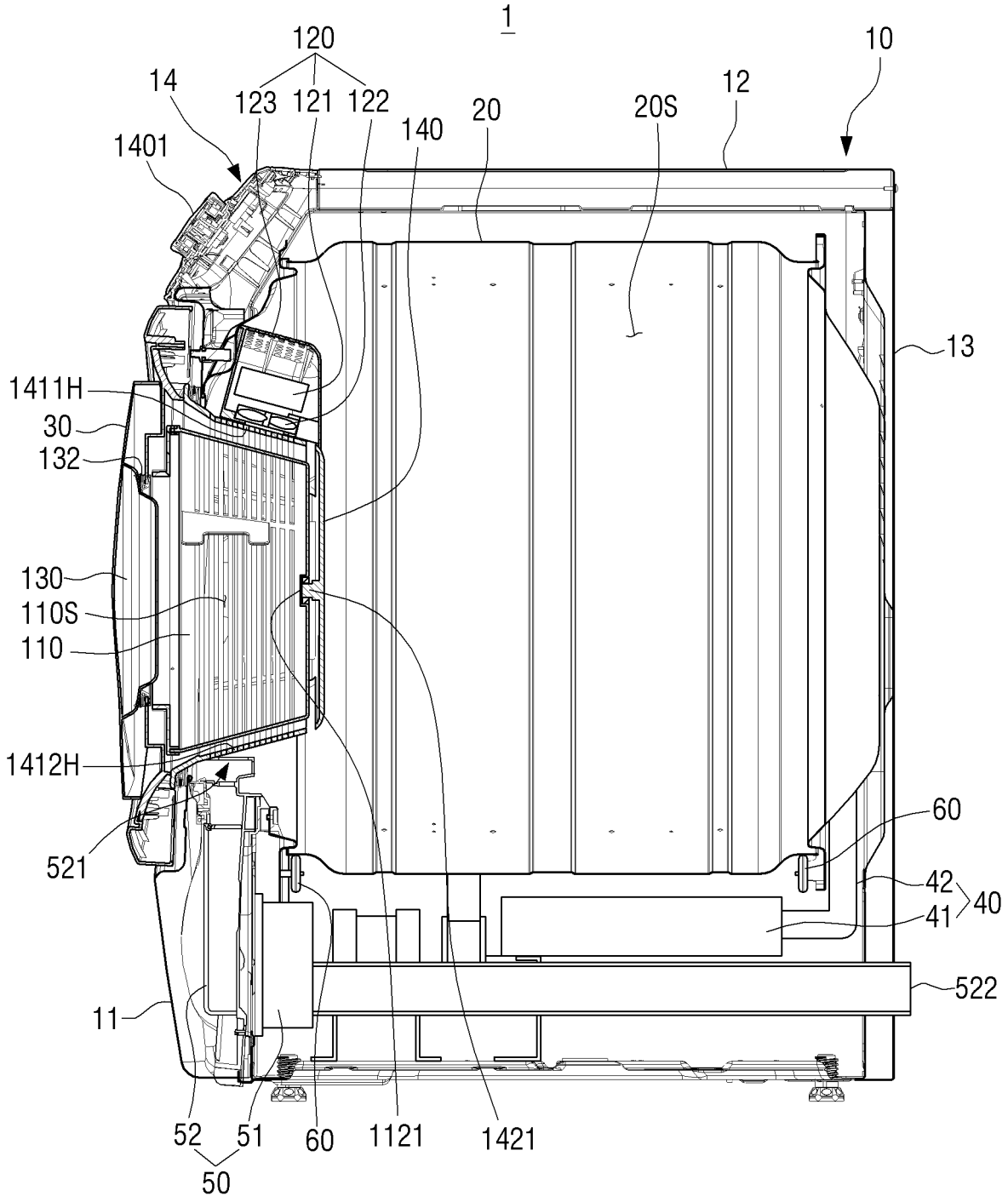
FIG. 4 is a side cross-sectional view of the dryer illustrated in FIG. 1.

In a state where the first door 30 is closed, the second drum case 140 may be disposed in the body 10 to protrude inwardly of the first drum 20 inside the body 10 (see FIG. 4).

The second drum case 140 may be in a shape of a cylinder, with a front side portion thereof being open toward the front of the body 10 to be connected to the second opening 30H.

In addition, the second drum 110 is rotatably disposed in the second drum case 140.

As the first door 30 opens or closes the first opening 10H by rotating around the first hinge 301, the second drum 110 and the second drum case 140 coupled to the first door 30 also rotate around the first hinge 301 together with the first door 30.

The second drum 110 includes the second drying chamber 110S (see FIG. 4) connected to the second opening 30H, and a drying object inserted through the second opening 30H may be dried in the second drying chamber 110S by hot air introduced into the second drying chamber 110S.

The second drum 110 may rotate by receiving a driving force from a driver 150 disposed at the first door 30. The structure in which the second drum 110 rotates through the driver 150 will be described later.

The second door 130 opening or closing the second opening 30H is coupled to the first door 30.

The second door 130 is pivotably coupled to the first door 30 to open or close the second opening 30H. The second door 130 may also be referred to as an auxiliary door.

Specifically, as illustrated in FIG. 3, a second hinge 1301 may be disposed at one side of the first door 30 adjacent to the second opening 30H, and the second door 130 may be connected to the second hinge 1301 to open or close the second opening 30H by rotating with respect to the second hinge 1301.

As illustrated in FIGS. 2 and 3, the first door 30 and the second door 130 may open or close the first and second openings 10H and 30H, respectively, rotating with respect to the first and second hinges 301 and 1301 in the horizontal direction.

The second door 130 may be circular to correspond to the shape of the second opening 30H, with a larger diameter than the second opening 30H.

Thus, a drying object may be inserted into the second drying chamber 110S of the second drum 110 through the second opening 30H by opening the second door 130.

In addition, the second door 130 may further include a window 131 disposed in a center portion thereof. The window 131 may be made of a light transmissive material such as glass or transparent plastic.

In addition, a sealing member 132 coupled or fixed to the second opening 30H or the window 131 may be further provided such that when the window 131 disposed in the center portion of the second door 130 is placed into the second opening 30H by closing the second door 130, the second door 130 may provide sealing between the window 131 and the second opening 30H to prevent leakage of hot air in a state where the second door 130 is closed.

Therefore, a user may visually check the inside of the second drying chamber 110S through the window 131, and check a state of a drying object that is being dried in the second drying chamber 110S in real time.

Figure 5:
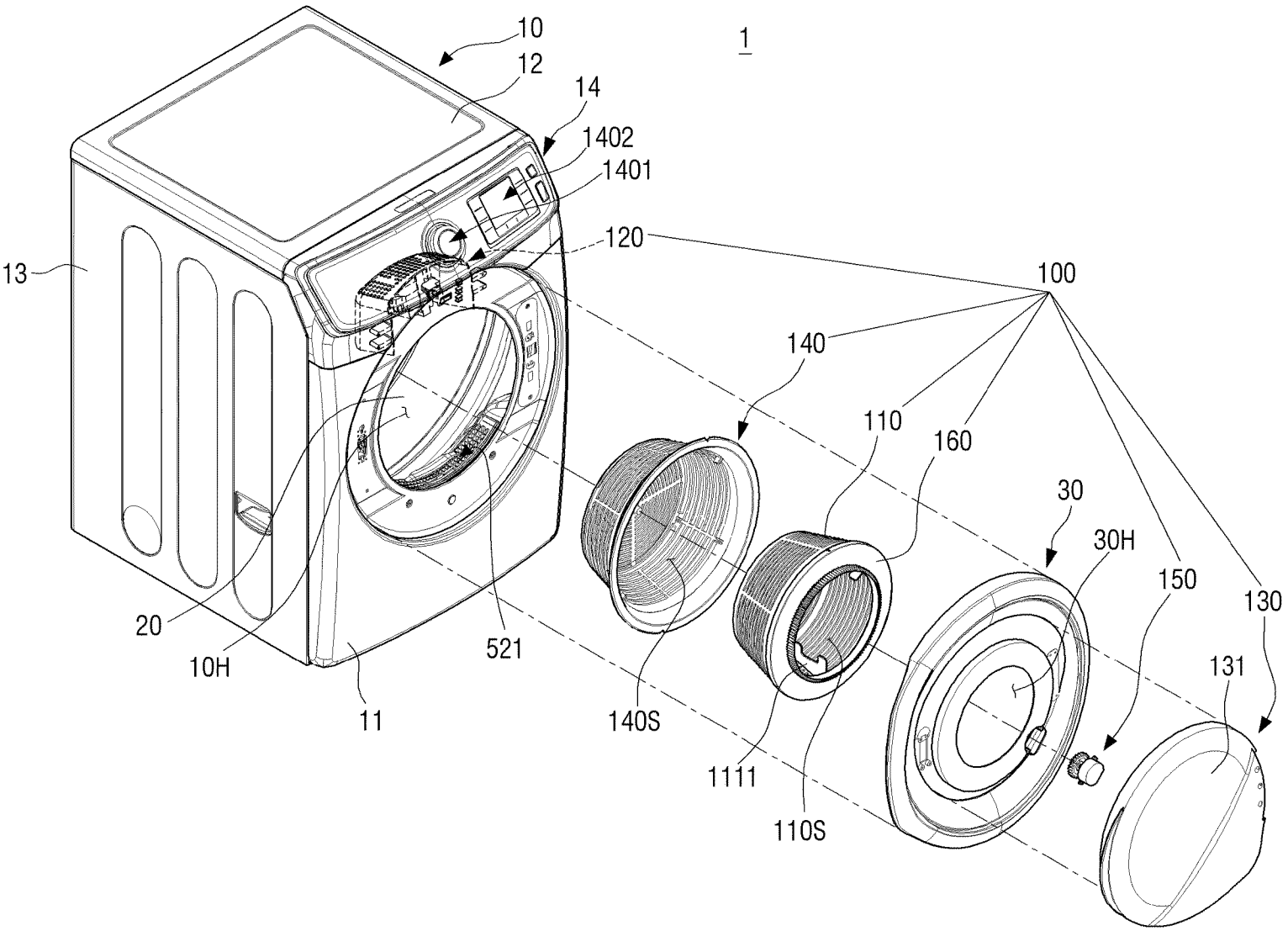
FIG. 5 is an exploded perspective view showing an auxiliary drying apparatus of the dryer illustrated in FIG. 1.
Figure 6:
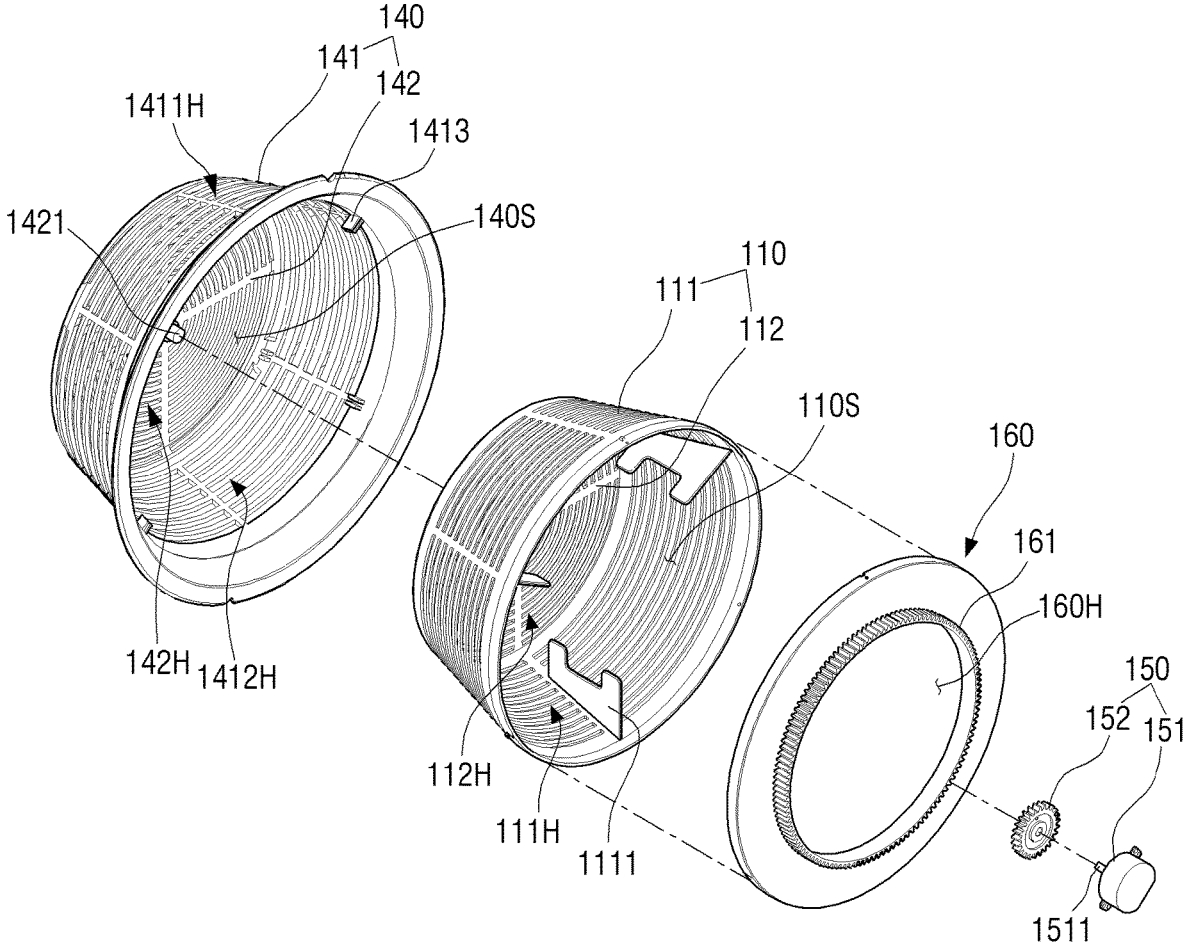
FIG. 6 is an exploded perspective view showing a second drum, a second drum case, a power transmission member, and a driver illustrated in FIG. 5.

FIG. 4 is a side cross-sectional view showing the inside of the dryer 1 illustrated in FIG. 1, FIG. 5 is an exploded perspective view showing an auxiliary drying apparatus 100 of the dryer 1 illustrated in FIG. 1, and FIG. 6 is an exploded perspective view showing the second drum 110, the second drum case 140, the power transmission member 160, and the driver 150 illustrated in FIG. 5.

Hereinafter, a specific structure of the dryer 1 will be described in detail with reference to FIGS. 4 to 6, focusing on the auxiliary drying apparatus 100.

As described above, the first drum 20 including the first drying chamber 20S is rotatably disposed in the body 10.

The first drum 20 may be in a shape of a cylinder that is open toward the front to be connected to the first opening 10H.

At least one driving roller 60 rotating in contact with the outer circumferential surface of the first drum 20 is disposed in the body 10.

The driving roller 60 may be included in a plural number, and the plurality of driving rollers 60 may rotate the first drum 20 by rotating through a driving force from a driver (not shown).

An outer circumferential surface of the driving roller 60, which is in contact with the outer circumferential surface of the first drum 20, may be made of a resin, such as rubber, to increase a friction with the outer circumferential surface of the first drum 20.

In addition, the first drum 20 may be in such a structure as to rotate through a driving shaft (not shown) directly coupled to the rotation center of the first drum 20, besides the plurality of driving rollers that rotate in contact with the outer circumferential surface of the first drum 20.

A first hot-air supplier 40 is disposed in the body 10 to supply hot air into the first drum 20.

The hot air generated from the first hot-air supplier 40 is introduced into the first drying chamber 20S to dry a drying object inserted into the first drying chamber 20S.

The first hot-air supplier 40 includes a first heater 41 and a first hot-air duct 42.

The first heater 41 includes a first heating member (not shown) and a first blower fan (not shown). Air heated through the first heating member may move through the first blower fan and then through the first hot-air duct 42 to the first drum 20.

The first hot-air duct 42 may be formed as a pipe connecting the first drum 20 and the first heater 41.

Thus, the hot air generated from the first heater 41 may be introduced into the first drying chamber 20S of the first drum 20 through the first hot-air duct 42.

The first heating member may be formed as an electric heater generating hot air using electric resistance heat of a coil, or may be formed as a gas heater generating hot air using combustion heat of gas.

The structures of the first drum 20 and the first hot-air supplier 40 described above are identical or similar to those of the conventional art. Thus, detailed descriptions thereof are omitted.

As described above, the first door 30 is coupled to the body 10 to open or close the first opening 10H, and the second door 130 is coupled to the first door 30 to open or close the second opening 30H.

The second drum case 140 is coupled to the internal side surface of the first door 30, and the second drum 110 is rotatably disposed in the second drum case 140.

Referring to FIGS. 4 and 5, a second hot-air supplier 120 is disposed in the body 10 to supply hot air into the second drum 110.

The second hot-air supplier 120 may be referred to as an auxiliary hot-air supplier.

The second hot-air supplier 120 may be disposed close to the first opening 10H and above the first opening 10H on the internal side surface of the front panel 11.

In addition, the second hot-air supplier 120 may be disposed close to the second drum case 140 to supply hot air to the second drum case 140, and may be disposed adjacent to an upper side of the second drum case 140 in a state where the first door 30 is closed.

The second hot-air supplier 120 includes a second heating member 121, a second blower fan 122, and a housing 123.

The second heating member 121 may be formed as an electric heater generating hot air through electric resistance heat of a coil, or may be formed as an electric heat-generating element using a positive temperature coefficient (PTC) thermistor.

The second blower fan 122 may enable air heated through the second heating member 121 to move to the second drum case 140, and may include a blower blade and a driving motor rotating the blower blade.

As illustrated in FIG. 4, the second blower fan 122 may be disposed below the second heating member 121 and between the second heating member 121 and the second drum case 140 to enable air heated from the second heating member 121 to move to the second drum case 140.

The second heating member 121 and the second blower fan 122 may be disposed in the housing 123, and the housing 123 may be coupled to the internal side surface of the front panel 11.

The housing 123 may protrude from the front panel toward the inside of the first drum 20, and one side thereof directed toward the second drum case 140 is open so that hot air generated from the second heating member 121 and the second blower fan 122 may move to the second drum case 140.

As illustrated in FIG. 4, a lower end portion of the housing 123 may be open toward the second drum case 140 disposed below the housing 123.

As described above, the second hot-air supplier 120 is coupled to the internal side of the body 10 to supply hot air to the second drum case 140 disposed adjacent thereto in a state where the first door 30 is closed. This makes it possible to solve a problem that installation of the second hot-air supplier 120 in the second drum 110 or the second drum case 140 causes a reduction in an internal volume of the second drying chamber 110S, thereby making it possible to increase an internal volume of the second drying chamber 110S of the second drum 110 disposed in the first door 30.

The second drum case 140, which is coupled to the internal side surface of the first door 30, protrudes inwardly of the first drying chamber 20S in a state where the first door 30 is closed.

As illustrated in FIGS. 4 to 6, the second drum case 140 may be formed in a shape of a cylinder that is open toward the second opening 30H, and includes a rear surface 142 facing the second opening 30H and an outer circumferential surface 141 coupled to the rear surface 142.

One end of the outer circumferential surface 141 of the second drum case 140 is coupled to the first door 30 to fix the second drum case 140 to the first door 30.

The second drum case 140 includes an inlet port 1411H through which hot air is introduced from the second hot-air supplier 120 and an exhaust port 1412H through which the introduced hot air is discharged.

As illustrated in FIG. 4, the inlet port 1411H may be disposed in an upper end portion of the outer circumferential surface 141 of the second drum case 140.

In a state the first door 30 is closed, the second hot-air supplier 120 is disposed adjacent to the inlet port 1411H of the second drum case 140, and the second hot-air supplier 120 may easily supply hot air to the inside of the second drum case 140 through the inlet port 1411H disposed adjacent thereto.

The exhaust port 1412H may be disposed in a lower end side opposite to the inlet port 1411H, and may be disposed in a lower end portion of the outer circumferential surface 141 of the second drum case 140.

Accordingly, hot air introduced from the second hot-air supplier 120 to the inlet port 1411H may pass through the inside of the second drum case 140 and may be discharged to the outside of the second drum case 140 through the exhaust port 1412H disposed in the lower end portion of the outer circumferential surface 141 of the second drum case 140.

As illustrated in FIGS. 5 and 6, the inlet port 1411H and the exhaust port 1412H of the second drum case 140 may be formed in a grill structure in the outer circumferential surface 141 of the second drum case 140.

Also, the outer circumferential surface 141 of the second drum case 140 may be formed in a grill structure with a plurality of holes over the entirety thereof.

Thus, the inlet port 1411H of the second drum case 140 may collectively refer to a plurality of holes arranged in the upper end portion of the outer circumferential surface 141 of the second drum case 140 adjacent to the second hot-air supplier 120, and the exhaust port 1412H of the second drum case 140 may collectively refer to a plurality of holes arranged in the lower end portion of the outer circumferential surface 141 of the second drum case 140.

An accommodation space 140S is provided inside the second drum case 140 in which the second drum 110 may be rotatably accommodated.

The second drum 110 is disposed in the accommodation space 140S of the second drum case 140.

The second drum 110 may be disposed in the horizontal direction with respect to the installation surface of the body 10, and may be in a shape of a cylinder that rotates with respect to a rotation center disposed in the horizontal direction.

In addition, the rotation center of the second drum 110 may be formed in the front-rear horizontal direction, with a front side portion thereof being open toward the front of the body 10 to be connected to the second opening 30H.

The second drum 110 may be formed in a shape of a cylinder to correspond to the second drum case 140, and may be formed in the shape of the cylinder that is open toward the second opening 30H.

The second drum 110 is formed to be smaller in size than the first drum 20, and accordingly, the second drying chamber 110S is also smaller in volume than the first drying chamber 20S.

Therefore, a smaller amount of a drying object may be inserted into the second drying chamber 110S for drying than that of a drying object that may be dried through the first drying chamber 20S.

The second drum 110 is rotatably supported in the second drum case 140, thereby rotating while being coupled to the first door 30.

Each of the first drum 20 and the second drum 110 may rotate around the rotation center disposed in the horizontal direction with respect to the installation surface of the body 10. In addition, the rotation center of the first drum 20 and the rotation center of the second drum 110 may be disposed coaxially.

The second drying chamber 110S described above may be referred to as an auxiliary drying chamber, the second drum 110 may be referred to as a rotating drum, and the second drum case 140, in which the second drum 110 is rotatably disposed, may be referred to as a fixed drum.

As illustrated in FIG. 6, the second drum 110 includes a rear surface 112 facing the rear surface 142 of the second drum case 140 and an outer circumferential surface 111 coupled to the rear surface 112 of the second drum 110.

The second drum 110 includes a plurality of vents 111H facing the inlet port 1411H and the exhaust port 1412H of the second drum case 140.

The plurality of vents 111H described above may be formed in the outer circumferential surface 111 of the second drum 110 to face the inlet port 1411H and the exhaust port 1412H formed in the outer circumferential surface 141 of the second drum case 140.

Accordingly, hot air generated from the second hot-air supplier 120 may be introduced into the second drum case 140 through the inlet port 1411H of the second drum case 140 and the hot air introduced into the second drum case 140 may be introduced into the second drum 110, i.e. the second drying chamber 110S, through the plurality or vents 111H of the second drum 110 facing the inlet port 1411H.

Thus, a drying object disposed in the second drying chamber 110S may be dried by the hot air introduced into the second drying chamber 110S through the plurality of vents 111H.

In addition, the hot air (air) containing moisture when the drying of the drying object is completed after the hot air is introduced into the second drying chamber 110S may be discharged through the exhaust port 1412 of the second drum case 140 after passing through the plurality of vents 111H disposed adjacent to the exhaust port 1412H.

The second drum 110 rotates in the second drum case 140, and accordingly, the plurality of vents 111H disposed in the outer circumferential surface 111 of the second drum 110 also rotate with respect to the rotation center of the second drum 110.

Thus, the plurality of vents 111H disposed in the outer circumferential surface 111 of the second drum 110 may sequentially face the inlet port 1411H and the exhaust port 1412H of the second drum case 140 as the second drum 110 rotates.

In addition, the second drum 110 may be formed as a grill structure with the plurality of vents 111H over the entirety of the outer circumferential surface 111 of the second drum 110.

Based thereon, the second drum 110, which rotates in the second drum case 140, is enabled to effectively introduce hot air passing through the inlet port 1411H into the second drying chamber 110S and effectively discharge the hot air by which the drying is completed in the second drying chamber 110S through the exhaust port 1412H.

In addition, the above-described air suction port 521 of the exhaust duct 52 is disposed under the exhaust port 1412H.

Specifically, as illustrated in FIG. 4, an exhauster 50 including the exhaust duct 52 is disposed in the body 10 to discharge air in the first and second drums 20 and 110 to the outside of the body 10.

The exhauster 50 includes an exhaust fan 51 and the exhaust duct 52, and may discharge, to the outside of the body 10, hot air containing moisture in the first and second drying chambers 20S and 110S as a result of performing drying.

As illustrated in FIG. 4, the air suction port 521 of the exhaust duct 52 is disposed under the second drum case 140 and adjacent to the exhaust port 1412H of the second drum case 140 to effectively suck hot air passing through the second drying chamber 110S into the exhaust duct 52.

In addition, the air suction port 521 of the exhaust duct 52 may be disposed close to an opening portion of the first drum 20 to suck hot air containing moisture after drying is completed in the first drying chamber 205.

To do this, the air suction port 521 of the exhaust duct 52 may include a plurality of holes. Specifically, the air suction port 521 of the exhaust duct 52 may include a plurality of holes that are open upwardly toward the exhaust port 1412H of the second drum case 140 and a plurality of holes that are open backwardly, i.e. inwardly of the first drum 20, on the basis of FIG. 4.

The exhaust fan 51 may include a suction blade (not shown) and a drive motor (not shown) rotating the suction blade. Air in the first and second drying chambers 20S and 110S may be sucked through the air suction port 521 into the air suction port 521 by rotating the suction blade.

A discharging port 522 of the exhaust duct 52 may be disposed in the side-rear panel 13 to discharge hot air sucked into the air suction port 521 to the outside of the body 10.

In addition, as illustrated in FIGS. 5 and 6, the second drum case 140 may include an auxiliary inlet port 142H that is open toward the first drying chamber 20S.

The auxiliary inlet port 142H may be a plurality of holes formed in the rear surface 142 of the second drum case 140 facing a rear surface of the first drum 20.

Thus, the air in the first drum 20, i.e. the first drying chamber 20S, may be introduced into the second drum case 140 through the auxiliary inlet port 142H.

In addition, the second drum 110 may further include a plurality of auxiliary vents 112H facing the auxiliary inlet port 142H of the second drum case 140.

The plurality of auxiliary vents 112H may be formed in the rear surface 112 of the second drum 110 facing the rear surface 142 of the second drum case 140.

Thus, some of hot air introduced into the first drying chamber 20S through the first hot-air supplier 40 may flow into the second drum 110 through the auxiliary inlet port 142H and the auxiliary vents 112H, and the hot air introduced into the second drum 110 may be discharged out of the air suction port 521 of the exhaust duct 52 through the exhaust port 1412H of the second drum case 140.

In addition, the auxiliary inlet port 142H of the second drum case 140 may be formed in a grill structure in the surface 142 of the second drum case 140, and the plurality of auxiliary vents 112H of the second drum 110 may also be formed in a grill structure in the rear surface 112 of the second drum 110.

By forming the second drum 110 and the second drum case 140 in a grill structure with a plurality of holes over the entirety of their surfaces as described above, it is possible to enable hot air introduced from the first and second hot-air suppliers 40 and 120 to effectively pass therethrough.

In addition, as illustrated in FIG. 6, a plurality of support protrusions 1413 may be disposed on an internal side of a circumferential surface 141 (an inner circumferential surface) of the second drum case 140.

The plurality of support protrusions 1413 may be arranged at predetermined intervals along a circumferential direction of the second drum case 140, and may protrude toward a rotation center of the second drum case 140.

Thus, the plurality of support protrusions 1413 may support the outer circumferential surface 111 of the second drum 110 rotating in the accommodation space 140S, and accordingly, the second drum 110 may stably rotate inside the second drum case 140.

In addition, as illustrated in FIGS. 4 and 6, a coupling groove 1121 is formed in a center portion of the rear surface 112 of the second drum 110, and a coupling protrusion 1421 to be inserted into the coupling groove 1121 of the second drum 110 is formed at a center portion of the rear surface 142 of the second drum case 140 to protrude toward the coupling groove 1121.

The coupling groove 1121 of the second drum 110 and the coupling protrusion 1421 of the second drum case 140 may be disposed on the rotation center of the second drum 110. Accordingly, the second drum 110 may be coupled to the coupling protrusion 1421 to rotate with respect to the rotation center.

As described above, even though the second drum 110 rotates with respect to the rotation center disposed in the horizontal direction inside the second drum case 140, the second drum 110 is supported by the plurality of support protrusions 1413. Thus, the second drum 110 may stably rotate without sagging.

In addition, at least one lifter 1111 may be disposed on an internal side of a circumferential surface 111 (an inner circumferential surface) of the second drum 110.

The lifter 1111 may be formed in a plural number, and the plurality of lifters 1111 may be arranged at regular intervals along a circumferential direction of the second drum 110.

In addition, the lifter 1111 may be formed in a shape of a blade extending in a longitudinal direction of the outer circumferential surface 111 of the second drum 110 and protruding toward the rotation center of the second drum 110.

The lifter 1111 may tumble a drying object by lifting and dropping the drying object inserted into the second drying chamber 110S as the second drum 110 rotates.

In addition, the first drum 20 may also include at least one lifter disposed on an inner circumferential surface thereof.

As illustrated in FIGS. 5 and 6, the driver 150 is disposed at the first door 30 to apply a driving force to the second drum 110.

Specifically, the driver 150 includes a motor 151 coupled to the first door 30 and a drive gear 152 coupled to a motor shaft 1511 of the motor 151 for rotation.

In addition, the power transmission member 160 is coupled to an opening portion of the second drum 110 to obtain a driving force from the driver 150 and transmit the driving force to the second drum 110.

The power transmission member 160 may be in a shape of a ring surrounding the opening portion of the second drum 110, and includes a third opening 160H formed in a center portion thereof and a gear portion 161 disposed along an outer circumference of the third opening 160H.

The third opening 160H may be a through hole passing through the power transmission member 160, and may connect the second drying chamber 110S and the second opening 30H.

The third opening 160H is preferably formed in such a size that a drying object may easily be inserted into the second drying chamber 110S.

In addition, the gear portion 161 may be formed as a ring-shaped rack gear surrounding the outer circumference of the third opening 160H, and is engaged with the drive gear 152 of the driver 150.

In addition, a rotation center of the power transmission member 160 may coincide with the rotation center of the second drum 110, and a rotation center of the gear portion 161 may coincide with the rotation center of the second drum 110.

Thus, when the drive gear 152 is rotated by operating the motor 151, the gear portion 161 engaged with the drive gear 152 rotates with respect to the rotation center of the second drum 110, and thereby, the second drum 110, to which the power transmission member 160 is coupled, may rotate around the coupling protrusion 1421 disposed at the center of rotation.

In addition, the processor may regulate a rotation speed of the second drum 110 by regulating a rotation speed of the motor 151.

Meanwhile, the second drum 110 may rotate at a constant speed during a process of drying a drying object.

Thus, the drive gear 152 can be rotated at a constant speed by using the motor 151 including a simple structure for rotating the motor shaft 1511 at a constant speed without including a separate control structure. By changing a diameter of the gear portion 161, a gear ratio between the gear portion 161 and the drive gear 152 can be set to be optimal, the number of rotations of the second drum 110 can be changed, and a size of an insertion hole, into which a drying object is inserted, can be easily changed.

Specifically, the motor 151 is formed as a simple-structure motor only capable of rotating the motor shaft 1511 at a constant speed without particularly regulating a speed, and a separate component constituting an optimal gear ratio is coupled to the second drum 110 to configure a diameter of the gear portion 161 depending on a set rotation speed of the motor shaft 1511. Therefore, the second drum may be rotated constantly at an optimal speed as required by only turning on or off the motor 151 through the processor, and a size of the insertion hole may also be easily changed.

The second drum 110 may be rotatably disposed inside the second drum case 140 with a simple structure as described above, thereby effectively tumbling a drying object.

The second drum 110, the second hot-air supplier 120, the second door 130, the second drum case 140, the driver 150, and the power transmission member 160 described above may be collectively referred to as the auxiliary drying apparatus 100.

Figure 7:
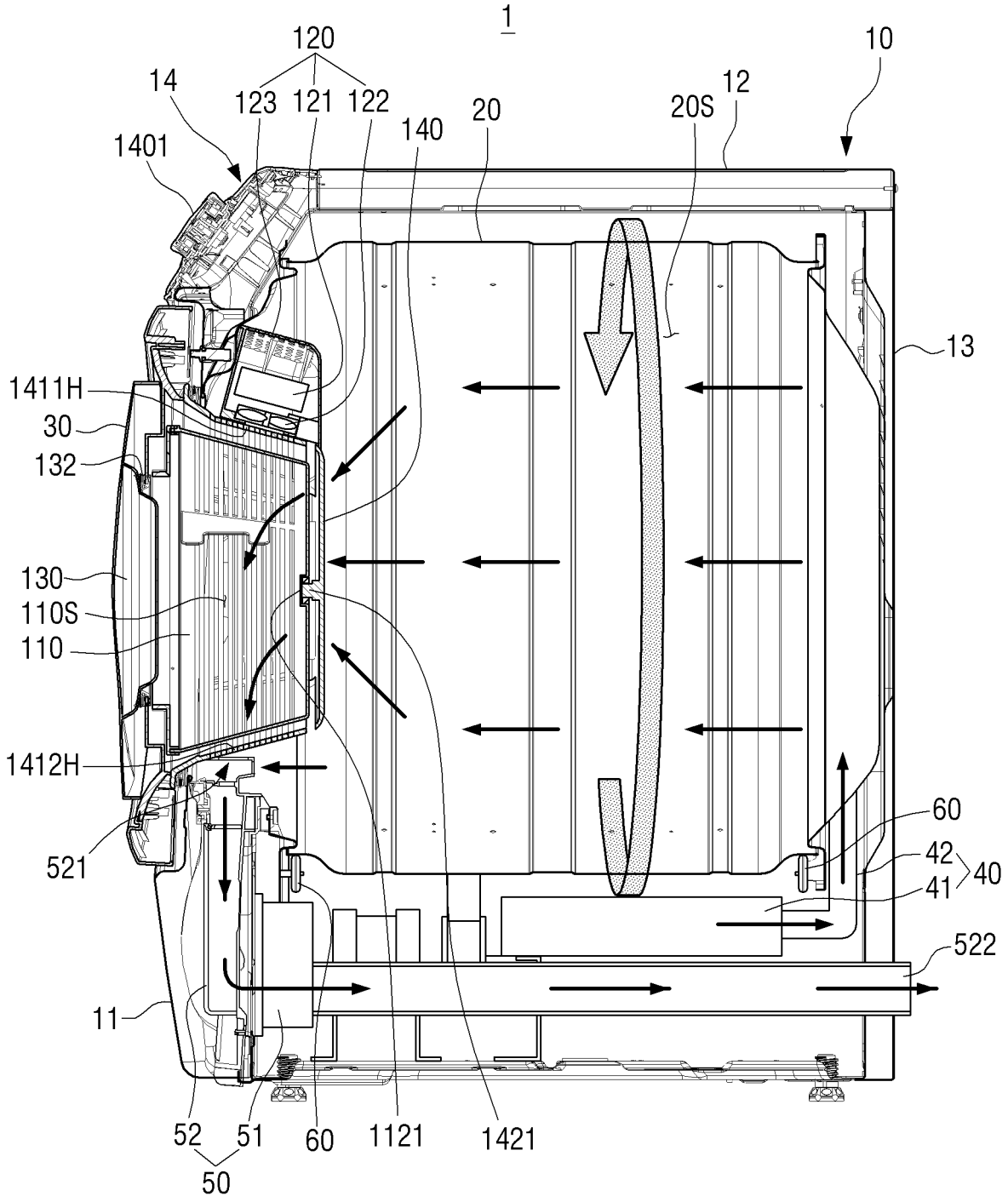
FIG. 7 is a diagram showing an operation in a first drying mode of the dryer illustrated in FIG. 4.
Figure 8:
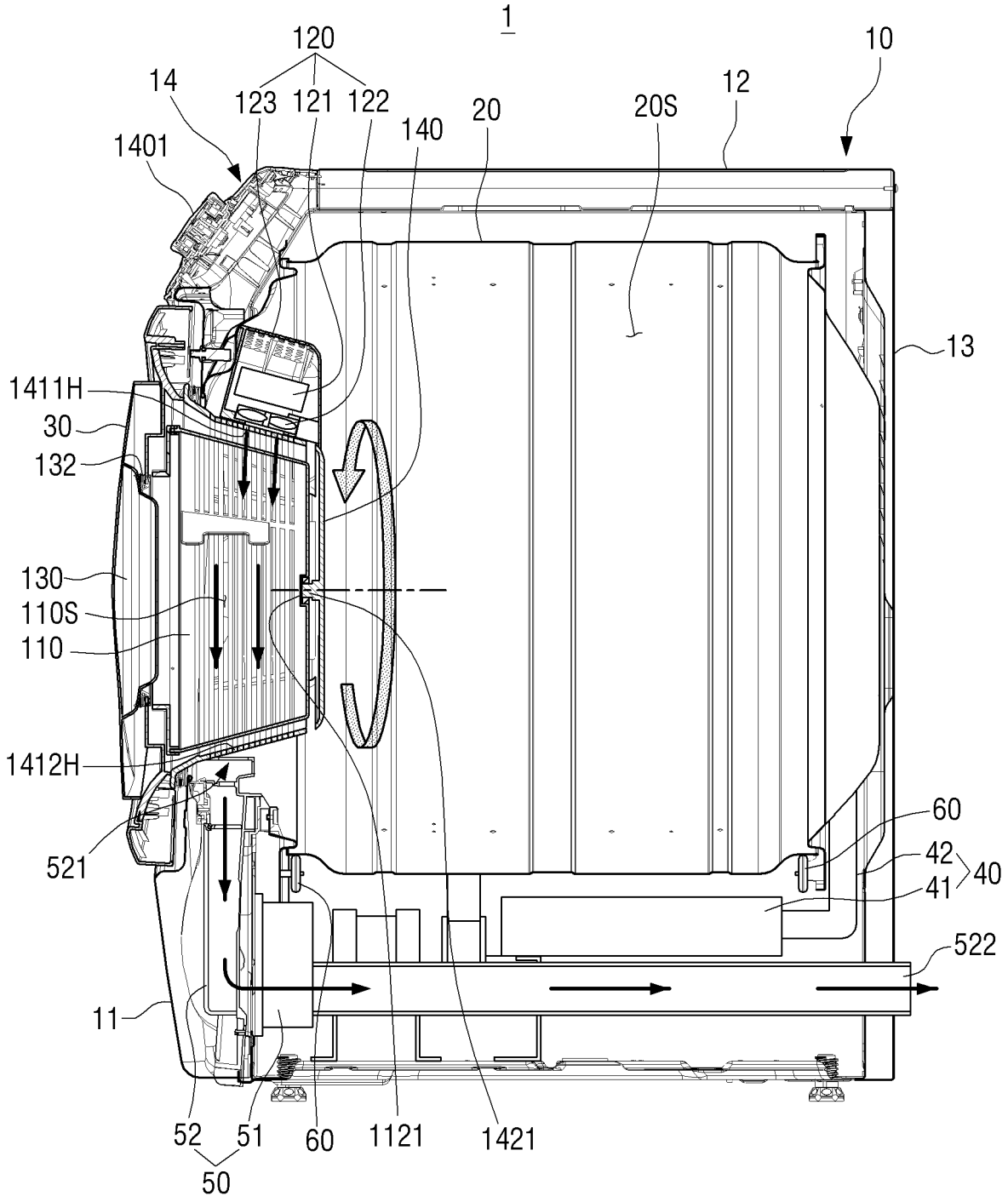
FIG. 8 is a diagram showing an operation in a second drying mode of the dryer illustrated in FIG. 4.
Figure 9:
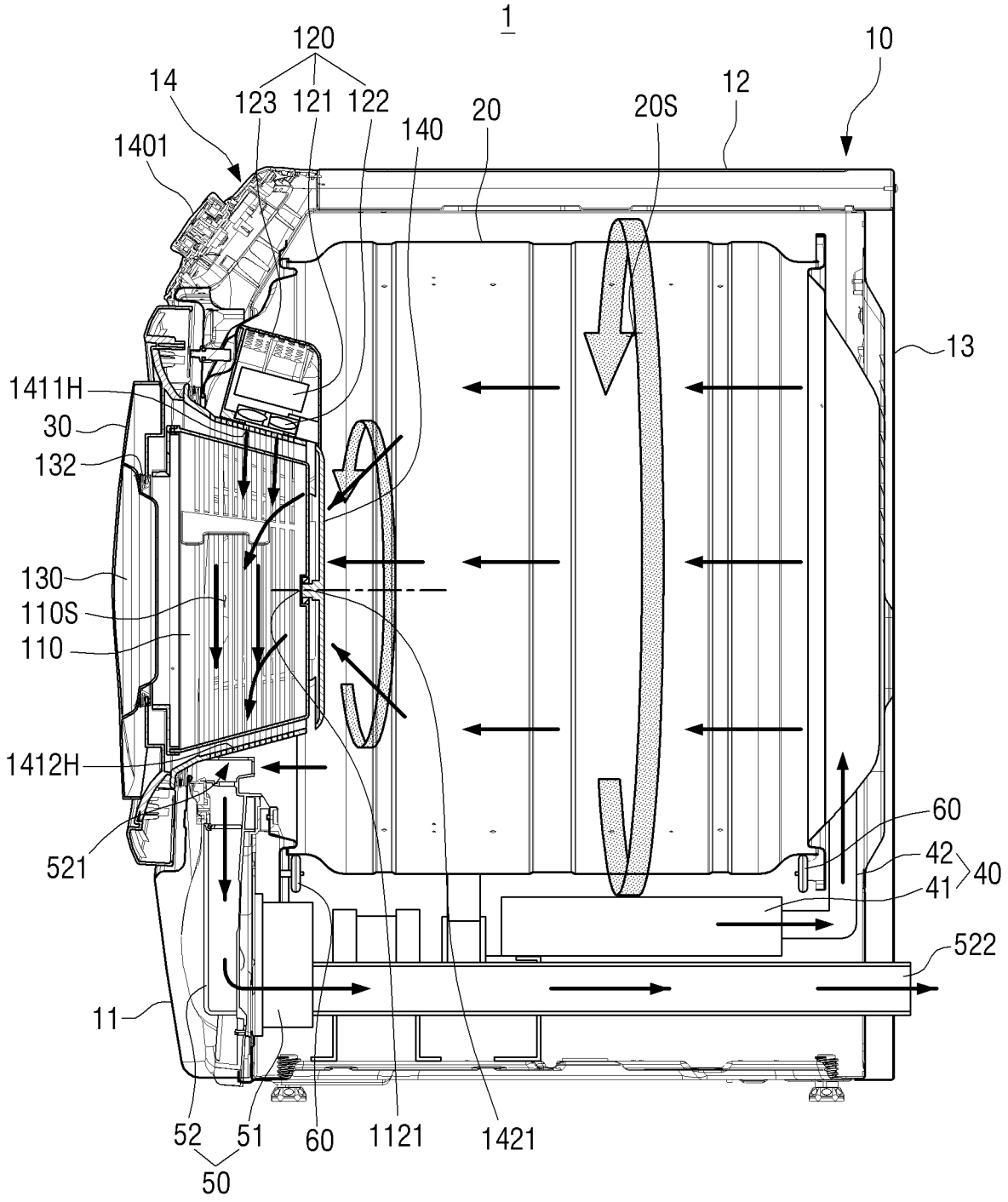
FIG. 9 is a diagram showing an operation in a third drying mode of the dryer illustrated in FIG. 4.
Figure 10:
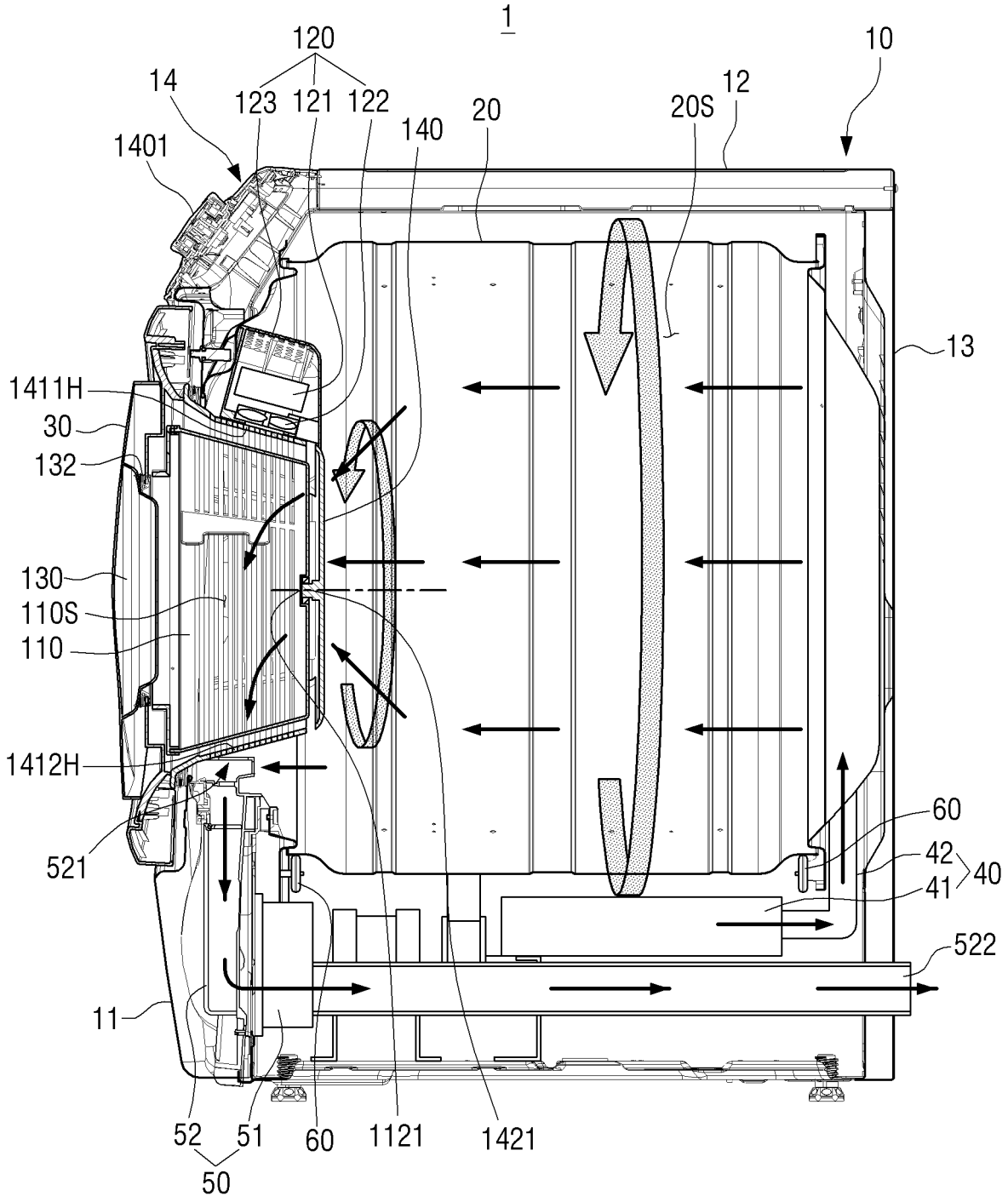
FIG. 10 is a diagram showing an operation in a fourth drying mode of the dryer illustrated in FIG. 4.

FIG. 7 is a diagram showing an operation in a first drying mode of the dryer 1 illustrated in FIG. 4, FIG. 8 is a diagram showing an operation in a second drying mode of the dryer 1 illustrated in FIG. 4, FIG. 9 is a diagram showing an operation in a third drying mode of the dryer 1 illustrated in FIG. 4, and FIG. 10 is a diagram showing an operation in a fourth drying mode of the dryer 1 illustrated in FIG. 4.

In FIGS. 7 to 10, a flow of hot air moving in the body 10 as the dryer 1 operates is illustrated as an arrow.

Hereinafter, the operations of the dryer 1 in the first to fourth drying modes will be described with reference to FIGS. 7 to 10.

Referring to FIG. 7, the dryer 1 may operate in the first drying mode in which the first drum 20 rotates while being supplied with hot air from the first hot-air supplier 40.

When the dryer 1 operates in the first drying mode, the second drum 110 does not rotate and its position is fixed in a state where the second hot-air supplier 120 does not operate.

A user may open the first door 30, insert a large amount of a drying object into the first drum 20, and then operate the dryer 1 in the first drying mode.

By operating the dryer 1 in the first drying mode, the drying object inserted into the first drying chamber 20S may be tumbled in the rotating first drum 20 and dried by hot air introduced into the first drying chamber 20S from the first hot-air supplier 40.

In addition, the hot air containing moisture after the drying is completed in the first drying chamber 20S may be sucked into the air suction port 521 of the exhaust duct 52 and then discharged to the outside of the body 10 through the discharging port 522 of the exhaust duct 52.

In addition, some of the hot air introduced into the first drum 20 from the first hot-air supplier 40 may be introduced into the second drying chamber 110S through the auxiliary inlet port 142H of the second drum case 140 and the plurality of auxiliary vents 112H of the second drum 110.

Therefore, by operating the dryer 1 in the first drying mode in a state where a small amount of delicate clothing (e.g. wool knits or baby clothing) made of a material that is easily damaged by an external force and heat is additionally inserted into the second drying chamber 110S, it is possible to dry a drying object in the first drying chamber 20S and simultaneously dry the delicate clothing in the second drying chamber 110S using hot air introduced thereinto from the first drying chamber 20*s*.

In this case, the second drum 110 does not rotate. Thus, the drying object disposed in the second drying chamber 110S may be dried while being placed inside the second drum 110, not being tumbled.

In addition, the hot air is introduced into the second drying chamber 110S from the first drying chamber 20S at a reduced temperature by passing through the first drying chamber 110S. Thus, the delicate clothing inserted into the second drying chamber 110S may be dried by hot air at a relatively low temperature, thereby being prevented from being damaged by high-temperature heat.

As described above, the dryer 1 may operate in the first drying mode to not only dry a large amount of a drying object inserted into the first drying chamber 20S but also additionally dry a small amount of delicate clothing inserted into the second drying chamber 110S using the hot air introduced into the second drying chamber 110S.

Referring to FIG. 8, the dryer 1 may operate in the second drying mode in which the second drum 110 rotates while being supplied with hot air from the second hot-air supplier 120.

When the dryer 1 operates in the second drying mode, the first drum 20 does not rotate and its position is fixed in a state where the first hot-air supplier 40 does not operate.

A user may open the second door 130, insert a small amount of a drying object into the second drum 110, and then operate the dryer 1 in the second drying mode.

Thus, the hot air generated from the second hot-air supplier 120 may be introduced into the second drying chamber 110S through the plurality of vents 111H formed in the outer circumferential surface 111 of the second drum 110 after passing through the inlet port 1411H of the second drum case 140.

The drying object disposed in the second drying chamber 110S may be tumbled as the second drum 110S rotates, and dried by the hot air introduced into the second drying chamber 110S.

The hot air containing moisture after the drying is completed in the second drying chamber 110S may be sucked into the air suction port 521 of the exhaust duct 52 adjacent to the exhaust port 1412H through the exhaust port 1412H of the second drum case 140, and then discharged to the outside of the body 10 through the discharging port 522 of the exhaust duct 52.

By operating the dryer 1 in the second drying mode, it is possible to efficiently perform drying only for the drying object inserted into the second drum 110 without operating the first drum 20 and the first hot-air supplier 40.

By doing so, a small amount of a drying object can be dried only through the auxiliary drying apparatus 100, thereby increasing energy consumption efficiency in operating the dryer 1.

Referring to FIG. 9, the dryer 1 may operate in the third drying mode in which the first drum 20 rotates while being supplied with hot air from the first hot-air supplier 40, and the second drum 110 also rotates while being supplied with hot air from the second hot-air supplier 120.

A user may open the first door 30 and insert a large amount of a drying object into the first drum 20, open the second door 130 and insert, a small amount of a drying object into the second drum 110, and then operate the dryer 1 in the third drying mode.

Accordingly, drying in the first drying chamber 20S for the large amount of the drying object inserted thereinto may be simultaneously performed with drying in the second drying chamber 110S for the small amount of the drying object inserted thereinto.

The first drum 20 and the second drum 110 may rotate in the same direction, or may rotate in different directions from each other.

The small amount of the drying object inserted into the second drying chamber 110S may be delicate clothing that requires separate drying from the large amount of the drying object inserted into the first drying chamber 205.

By separately drying the delicate clothing and the large amount of the drying object in the first and second drying chambers 20S and 110S, respectively, at the same time, the delicate clothing can be dried without being damaged.

As a result, it is possible to improve drying performance for drying objects and convenience of usage.

Referring to FIG. 10, the dryer 1 may operate in the fourth drying mode in which the first drum 20 rotates while being supplied with hot air from the first hot-air supplier 40, and at the same time, the second drum 110 also rotates.

When the dryer 1 operates in the fourth drying mode, the second hot-air supplier 120 does not operate.

A user may open the first door 30 and insert a large amount of a drying object into the first drum 20, open the second door 130 and insert a small amount of a drying object into the second drum 110, and then operate the dryer 1 in the fourth drying mode.

Accordingly, drying in the first drying chamber 20S for the large amount of the drying object inserted thereinto may be simultaneously performed with drying in the second drying chamber 110S for the small amount of the drying object inserted thereinto.

The drying object inserted into the first drying chamber 20S may be tumbled inside the rotating first drum 20, and dried by the hot air introduced into the first drying chamber 20S introduced from the first hot-air supplier 40.

The small amount of the drying object inserted into the second drying chamber 110S may be delicate clothing that requires separate drying from the large amount of the drying object inserted into the first drying chamber 20S, and may be delicate clothing made of a material that is easily damaged by heat.

The drying object inserted into the second drying chamber 110S is dried by the hot air introduced into the second drying chamber 110S through the auxiliary inlet port 142H and the plurality of auxiliary vents 112H from the first drying chamber 20S.

In addition, the drying object disposed in the second drum 110 may be tumbled by rotating the second drum 110. Thus, it is possible to effectively perform drying.

By operating the dryer 1 in the fourth drying mode, while the large amount of the drying object is dried in the first drying chamber 20S, the drying object inserted into the rotating second drum 110 can be dried indirectly by the hot air from the first hot-air supplier 40.

Thus, the drying object inserted into the second drying chamber 110S may be dried by hot air at a relatively low temperature, thereby being prevented from being damaged by high-temperature heat.

Accordingly, the delicate clothing inserted into the second drying chamber 110S can be dried without being damaged by high-temperature heat, simultaneously with the drying object inserted into the first drying chamber 20S.

The dryer 1 according to an embodiment of the disclosure described above, which includes the first drum 20 including the first drying chamber 20S, the first hot-air supplier 40, the second drum. 110 including the second drying chamber 110S, and the second hot-air supplier 120, is capable of performing independent drying with respect to drying object in the first and second drying chambers 20S and 110S.

Based thereon, it is possible to perform drying in either the first drying chamber 20S or the second drying chamber 110S depending on an amount of a drying object, or it is possible to simultaneously dry drying objects in both the first and second drying chambers 20S and 110S depending on types of drying objects, thereby increasing efficiency, convenience, and versatility of the dryer 1.

In addition, the second drum 110 is connected to the first drying chamber 20S through the auxiliary inlet port 142H and the plurality of auxiliary vents 112H, so that drying in the second drying chamber 110S can be simultaneously performed using the hot air from the first hot-air supplier 40. Thus, it is possible to provide more various drying environments for the second drying chamber 110S.

Hereinabove, although diverse embodiments of the disclosure are each individually described, each of the embodiments is not necessarily implemented alone, and the configuration and operation of each of the embodiments may be implemented in combination with at least one other embodiment.

In addition, although the preferred embodiments of the disclosure have been illustrated and described hereinabove, the disclosure is not limited to the specific embodiments as described above, and may be variously modified by those skilled in the art to which the disclosure pertains without departing from the gist of the disclosure as claimed in the appended claims. Such modifications should not be individually understood from the spirit or prospect of the disclosure.

The invention claimed is:

1. A dryer comprising:

a body including a first opening in one side thereof;

a first drum rotatably disposed in the body and including a first drying chamber connected to the first opening;

a first hot-air supplier configured to supply hot air into the first drum;

a first door coupled to the body to open or close the first opening;

a second drum disposed on the first door;

a second hot-air supplier configured to supply hot air into the second drum; and a second drum case coupled to the first door, the second drum being rotatably disposed in the second drum case, wherein the second drum case includes an inlet port through which hot air is introduced from the second hot-air supplier and an exhaust port through which the introduced hot air is discharged, the second drum includes a plurality of vents facing the inlet port and the exhaust port, and the second hot-air supplier is disposed above the second drum case when the first door is in a closed state.

2. The dryer as claimed in claim 1, wherein the first door includes a second opening passing through the first door and a second door configured to open or close the second opening, and the second drum includes a second drying chamber connected to the second opening.

3. The dryer as claimed in claim 1, wherein the second hot-air supplier is disposed adjacent to the inlet port in a state where the first door is closed.

4. The dryer as claimed in claim 2, wherein the second drum is formed in a shape of a cylinder that is open toward the second opening, and the plurality of vents are formed in an outer circumferential surface of the second drum.

5. The dryer as claimed in claim 4, wherein the second drum case is formed as a shape of a cylinder, and the inlet port and the exhaust port are formed in an outer circumferential surface of the second drum case.

6. The dryer as claimed in claim 5, wherein the second drum case further includes an auxiliary inlet port that is open toward the first drying chamber.

7. The dryer as claimed in claim 6, wherein the second drum further includes a plurality of auxiliary vents facing the auxiliary inlet port.

8. The dryer as claimed in claim 7, wherein the inlet port, the auxiliary inlet port, and the exhaust port of the second drum case are formed in a grill structure, and the plurality of vents and the plurality of auxiliary vents of the second drum are formed in a grill structure.

9. The dryer as claimed in claim 1, wherein a driver is disposed at the first door, and a power transmission member is coupled to an opening portion of the second drum, the power transmission member transmitting a driving force of the driver to the second drum.

10. The dryer as claimed in claim 9, wherein the power transmission member includes a third opening and a gear portion disposed along an outer circumference of the third opening, and the driver includes a motor coupled to the first door and a drive gear coupled to the motor for rotation and engaged with the gear portion.

11. The dryer as claimed in claim 1, further comprising an exhaust duct configured to discharge air in the first drum and the second drum to the outside of the body, wherein an air suction port of the exhaust duct is disposed close to the exhaust port.

12. A dryer comprising a door configured to open or close an opening formed in one side of a body, a drying chamber rotatably disposed inside the body, and a hot-air supplier configured to supply hot air into the drying chamber, wherein an auxiliary drying chamber is disposed inside the door, and an auxiliary hot-air supplier is disposed adjacent to the auxiliary drying chamber to supply hot air into the auxiliary drying chamber, the door comprises an inlet port through which hot air is introduced from the auxiliary hot-air supplier and an exhaust port through which the introduced hot air is discharged, the inlet port and the outlet port disposed between the auxiliary hot-air supplier and the auxiliary drying chamber, the auxiliary drying chamber comprises a plurality of vents facing the inlet port and the exhaust port, and the auxiliary hot-air supplier is disposed above the auxiliary drying chamber when the door is in a closed state.

13. The dryer as claimed in claim 12, wherein the auxiliary drying chamber includes:

a fixed drum including a vent formed in a grill shape; and a rotating drum rotatably disposed inside the fixed drum and including a vent formed in a grill shape in communication with the vent of the fixed drum.

* * * * *